US005635095A

United States Patent [19]

Kleinfeld

[11] Patent Number: 5,635,095

[45] Date of Patent: Jun. 3, 1997

[54] METHOD FOR OPENING DISCHARGE OUTLETS

[75] Inventor: Jack M. Kleinfeld, Bronx, N.Y.

[73] Assignee: Champion International Corporation, Stamford, Conn.

[21] Appl. No.: 507,029

[22] Filed: Sep. 1, 1995

[51] Int. Cl.[6] ..... B22D 37/00

[52] U.S. Cl. ..... 222/590; 222/593; 266/236

[58] Field of Search ..... 266/45, 236, 271; 222/590, 592, 593

[56] References Cited

U.S. PATENT DOCUMENTS 4,202,533 5/1980 Daussan et al. ..... 266/45

4,750,649 6/1988 Fahey et al. ..... 222/590

*Primary Examiner*—Scott Kastler

[57] ABSTRACT

A method for shutting down and starting up a chemical recovery process of the type comprising burning concentrated black liquor in the furnace of a recovery boiler to produce a flue gas and a hot molten smelt in the bottom of said furnace and discharging the hot molten smelt in a continuous yet variable quantity via a smelt spout into a dissolving tank partially filled with an aqueous solution, said method comprising:

inserting an elongated heating element into said spout;

shutting down said boiler with said element in said spout such that on solidification of molten smelt in said spout said element is fixed in said solidified smelt; and starting up said boiler by heating said element to a temperature equal to or greater than the melting point of said smelt to form molten smelt and removing said element from said spout to provide a substantially open spout for discharge of said molten smelt from said furnace.

15 Claims, 4 Drawing Sheets

METHOD FOR OPENING DISCHARGE OUTLETS

BACKGROUND OF THE INVENTION

1. Field of the Invention

The present invention relates to an improved process of the type in which a molten material at elevated temperature is poured or dispensed from a container, vessel or the like, as for example a recovery boiler in a wood pulping process, where there is a tendency for the material to freeze or block the outlet of the container, vessel or the like during operation or shutdown of the process. In particular, the invention is directed to a method of shutting down and starting up, or correcting a freeze up of the process.

2. Description of the Prior

Processes are known in which a molten material is discharged from a vessel via some outlet. Illustrative of such processes are those for processing molten metals or metal alloys such as steel, iron, nickel and the like and for processing molten polymers such as polyesters, polycarbonates, polyamides and the like.

Such processes also include the recovery process in pulp mills. Pursuant to present-day paper pulp mill operations, raw wood is delignified by a thermo-chemical process comprising an approximately 350° F. cook in the presence of sodium hydroxide, sodium carbonate, sodium sulfide and other sodium based compounds. Under such conditions, the lignin binder in the raw wood matrix which holds the natural celluose fibers together reacts with the sodium and sulfur compounds to form water soluble lignin-sodium complexes thereby permitting a water wash separation of the black tar-like lignin from the fiber for manufacture of paper (or other cellulose materials).

Although the sodium compounds used in the afore-described process are relatively inexpensive, the quantities consumed in the production of an average pulp mill necessitate an economical recovery and recycle of the chemical values. Moreover, such sodium-lignin complexes contain sufficient heat value and volatility to contribute favorably to the overall mill heat balance. These characteristics are combined in the liquor recovery furnace by fueling a boiler furnace with a concentrated flow stream of the spent or black pulping liquor. for the Residual ash, predominately sodium carbonate and sodium sulfide falls to the furnace bed as a viscous smelt. Such smelt is removed from the furnace, shattered and dissolved in water to the green liquor makeup stream from which the other fresh cooking liquor compounds are made.

In transition from the furnace bed to a green liquor dissolving tank, smelt flows in thin continuous streams from numerous spouts around the furnace bed perimeter. Such smell streams fall directly into the dissolving tank. The smelt typically has a temperature of from about 800° F. to about 1800° F. as it is discharged from the recovery boiler. It is not possible to let this molten stream pour directly into the aqueous solution of the dissolving tank as this would cause a violent explosive reaction. To prevent or minimize violent reaction as the smelt combines with the aqueous green liquor the smelt spout streams are shattered into small particles as for example by dispersion jets of steam.

A similar problem exists in start-up of a shutdown recovery boiler and during process upset when the smelt in the smelt spout is accidentally or deliberately frozen. During shutdown, the temperature of the boiler is below normal operational temperature and as low as ambient temperature which results in the solidification of smelt in the bottom of the recovery boiler and in the recovery boiler smelt spout. On start-up or during process upset means must be provided to melt the frozen smelt in the spout to return it to operation. In the past, three methods have been used, each having disadvantages.

One method is to melt the smelt in the spout through use of a portable gas burner. This method has the disadvantage of a lack of convenience in the need for a gas supply and fuel supply equipment such as a vaporizer. This method is also time consuming in that the gas burner may have to be assembled and conveyed to the boiler for use.

In the other prior art methods, a rod is used. For example, in one method a metal rod is driven into the frozen smelt to unplug the spout. In the other method, a metal rod is placed in the spout prior to shutdown or upset and is withdrawn prior to start-up to provide an opening to the furnace. These methods also have disadvantages. For example, driving the rod into the frozen smelt often causes damage to the boiler and personal injury to the operator, and is time consuming and may require many hours i.e. 8 hours or more, to open the spout. In the other method, the rod is often fixed in the frozen smelt and cannot be withdrawn. Each of these methods suffer from the added disadvantage of explosive reaction between the molten smelt and the water on start-up or unpluggage of a frozen smelt spout of a furnace in operation. Normally, as the recovery boiler is started up, the smelt in the bottom of the furnace melts sooner than the smelt plugging the smelt pour spout. Similarly when the spout is unplugged after an upset, the smelt in the bottom of the furnace is in a molten state. In either case, when the spout is finally opened, a heavy flow of smelt into the water may occur with violent and explosive reaction resulting.

This invention obviates many disadvantages of the prior art processes. For example, this invention reduces the likelihood of a heavy flow of smelt into the water causing a violent and explosive reaction. This invention also provides for greater protection against damage to the boiler and increased speed of freeing a frozen spout as compared to the rod and gas burner methods. The present invention also provides for freedom from gas supply and fuel supply equipment difficulties attendant to the use of gas burner method, and is more reliable than the rod method for keeping a spout open through a shutdown for easy and safe start-up.

SUMMARY OF THE INVENTION

One aspect of this invention relates to a method for shutting down and starting up a process of the type comprising forming a hot molten material in a vessel, and discharging said material from discharge outlet of said vessel, said method comprising:

inserting an elongated heating element into said outlet;

cooling down said material in said vessel and said outlet to solidify said material such that said element is fixed in said solidified material in said outlet; and starting up said process by heating said element to a temperature equal to or greater than the melting point of said solidified material to form a molten material and removing said element from said outlet to provide a substantially open outlet for discharge of said molten material from said vessel.

Another aspect of this invention relates to a method for shutting down and starting up a chemical recovery process of the type comprising burning concentrated black liquor in the furnace of a recovery boiler to produce a flue gas and a hot molten smelt in the bottom of said furnace and discharging the hot molten smelt in a continuous yet variable quantity via a smelt spout into a dissolving tank partially filled with an aqueous solution, said method comprising:

inserting an elongated heating element into said spout;

shutting down said boiler with said element in said spout such that on solidification of molten smelt in said spout said element is fixed in said solidified smelt; and starting up said boiler by heating said element to a temperature equal to or greater than the melting point of said smelt to form a molten smelt and removing said element from said spout to provide a substantially open spout for discharge of said molten smelt from said furnace.

Yet another aspect of this invention relates to a method for opening a discharge outlet of a vessel used in a process of the type comprising forming a molten material in said vessel, and discharging said molten material from said vessel via said outlet wherein said material has solidified in said outlet preventing the discharge of material, said method comprising:

applying an elongated heating element heated to a temperature equal to or greater than the melting point of said solidified material to said material solidified in said outlet for a time sufficient to melt said solidified material to provide a substantially open discharge outlet for discharge of said molten material from said vessel.

Still another aspect of this invention relates to a method for opening a smelt spout of a recovery boiler used in a chemical recovery process of the type comprising burning concentrated black liquor in the furnace of a recovery boiler to produce a flue gas and a hot molten smelt in the bottom of said furnace and discharging the hot molten smelt in a continuous yet variable quantity via a smelt spout into a dissolving tank partially filled with an aqueous solution where said smelt has solidified in said spout to prevent the discharge of smelt into said tank, said method comprising:

applying an elongated heating element heated to a temperature equal to or greater than the melting point said smelt solidified in said spout for a time sufficient to melt said solidified smelt to provide a substantially open spout for discharge of said smelt from said furnace.

BRIEF DESCRIPTION OF THE DRAWINGS

In the following description of a preferred embodiment of this invention, reference will be made to the accompanying drawings, in which.

DETAILED DESCRIPTION OF THE INVENTION

Figure 1:
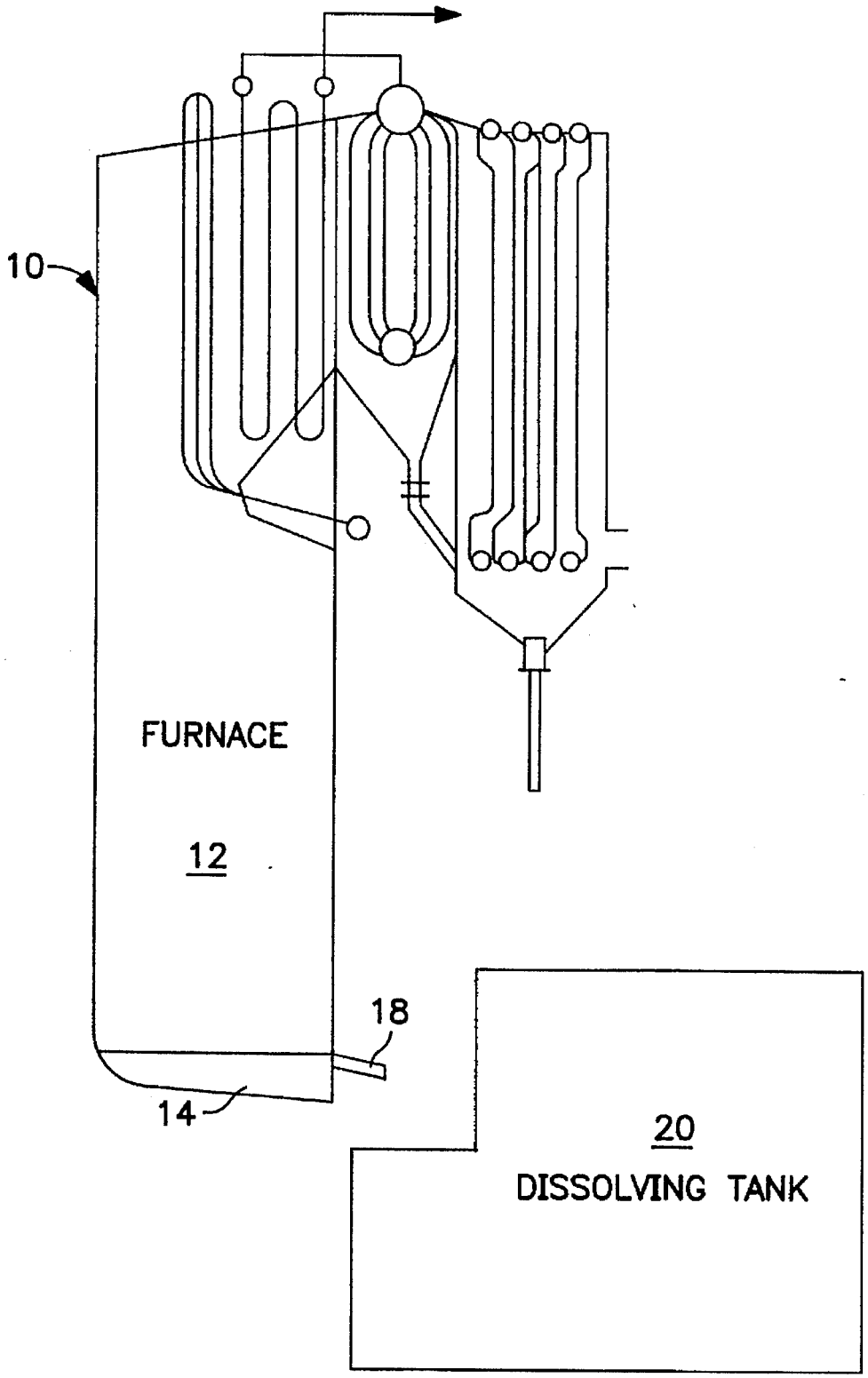
FIG. 1 is a partially schematic view of a typical recovery boiler and shows the location of the smelt pour spout and the smelt dissolving tank.

Referring to FIG. 1, the numeral 10 denotes generally a recovery boiler used in paper making and the numeral 20 denotes a soda dissolving tank. Boiler 10 includes a furnace 12 which contains a quantity of smelt 14 at its bottom and a smelt pour spout 18 discharging the molten smelt 14 from furnace 12. The remainder of the furnace 12 contains fumes and gases. During operation of the furnace 12, the smelt 14 and fumes and gases are at elevated temperatures. During shut down status, the fumes are condensed and the smelt 14 solidifies to a solid state. Dissolving tank 20 contains an aqueous solution, usually made with weak white liquor or weak liquor from the causticizing plant. During operation of the recovery boiler 10, continuous thin in streams of molten smelt 14 are discharged from furnace 12 via smelt pour spouts, whereafter the smelt 14 under free fall falls downward into dissolving tank 20 usually after treatment with some means (not depicted) to break up the continuous smelt streams into fine particles. The details of the construction of the recovery boiler 10 and dissolving tank 20 are disclosed for background purposes in explaining this invention and are not part of this invention.

Figure 3:
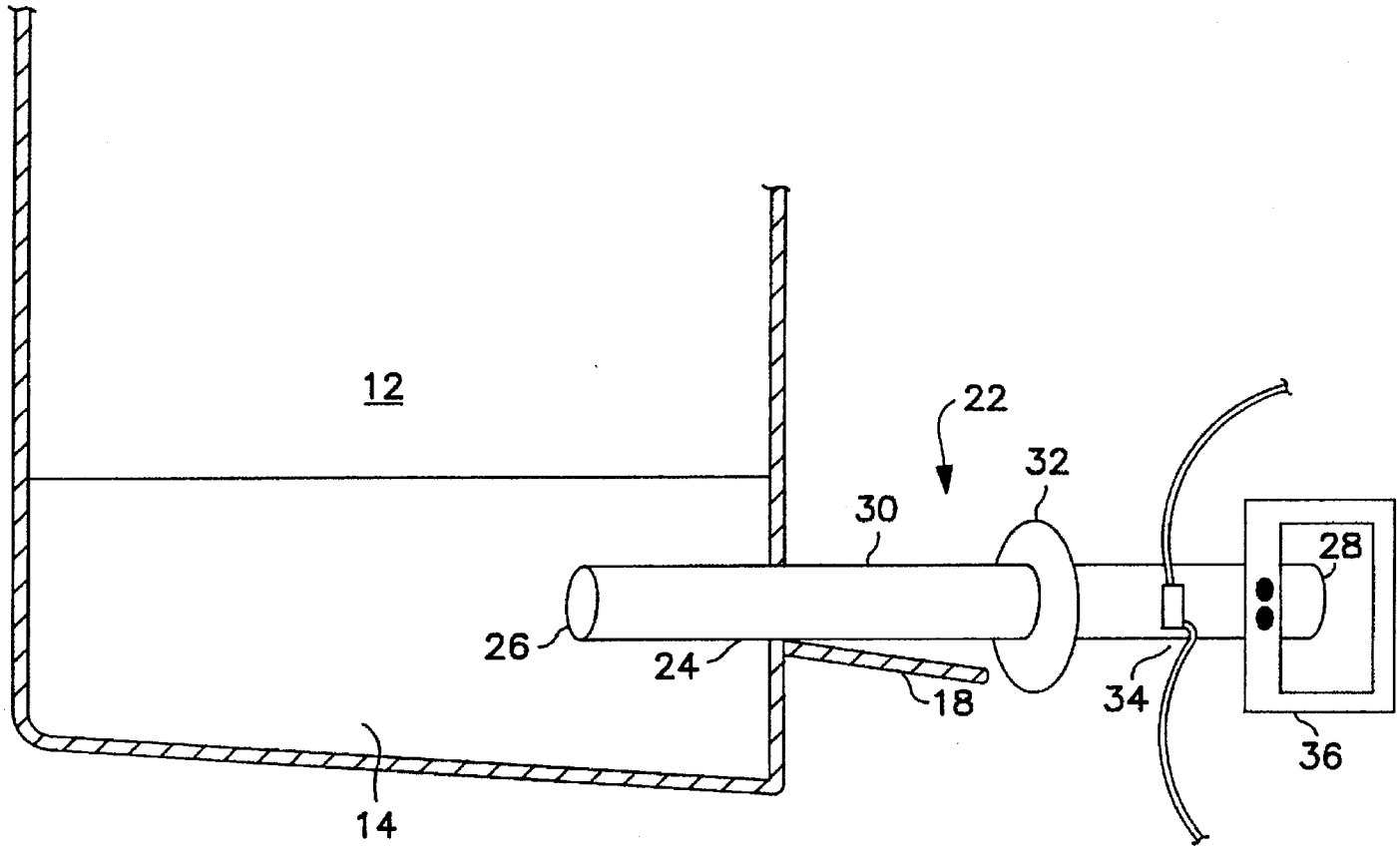
FIG. 3 is an enlarged cross-sectional view of a smelt pour spout of a recovery boiler in a shut-down status with a heating tube inserted therein.

The preferred embodiments of the present invention relate to an improvement in a process for shutting down and starting up a recovery boiler, and a process for freeing smelt pour spouts of recovery boilers intentionally or accidentally frozen during operation. Concentrated black liquor is introduced into an upper portion of furnace 12 where it is converted into a low BTU gaseous fumes and reduced smelt 14 by partial oxidation with air. Typically furnace 12 is operated at elevated temperature. Inorganic components of the black liquor are melted to form smelt 14 which is discharged from the bottom of furnace 12 through spout 18 into dissolving tank 20. During shut down, the furnace is turned off and smelt 14 remaining in the furnace 12 and in spout 18 begins to solidify. A preferred embodiment of this invention for shutting down and starting up a furnace is depicted in FIG. 3. As shown in FIG. 3, at some point in time prior to shut down to some point after shut down but prior to solidification of the smelt, elongated heating element 22 is inserted into spout 18 and left in place during shut down. Preparatory to start-up of furnace 12, heating element 22 is heated to temperature sufficiently high to allow removal of heating element 22 from spout 18, usually a temperature equal to or greater than the melting point of the smelt, to provide an open spout 18 for safe start-up of boiler 10 and thereby prevent or reduce explosive discharge of melted smelt 14 from furnace 12 into tank 20.

Figure 4:
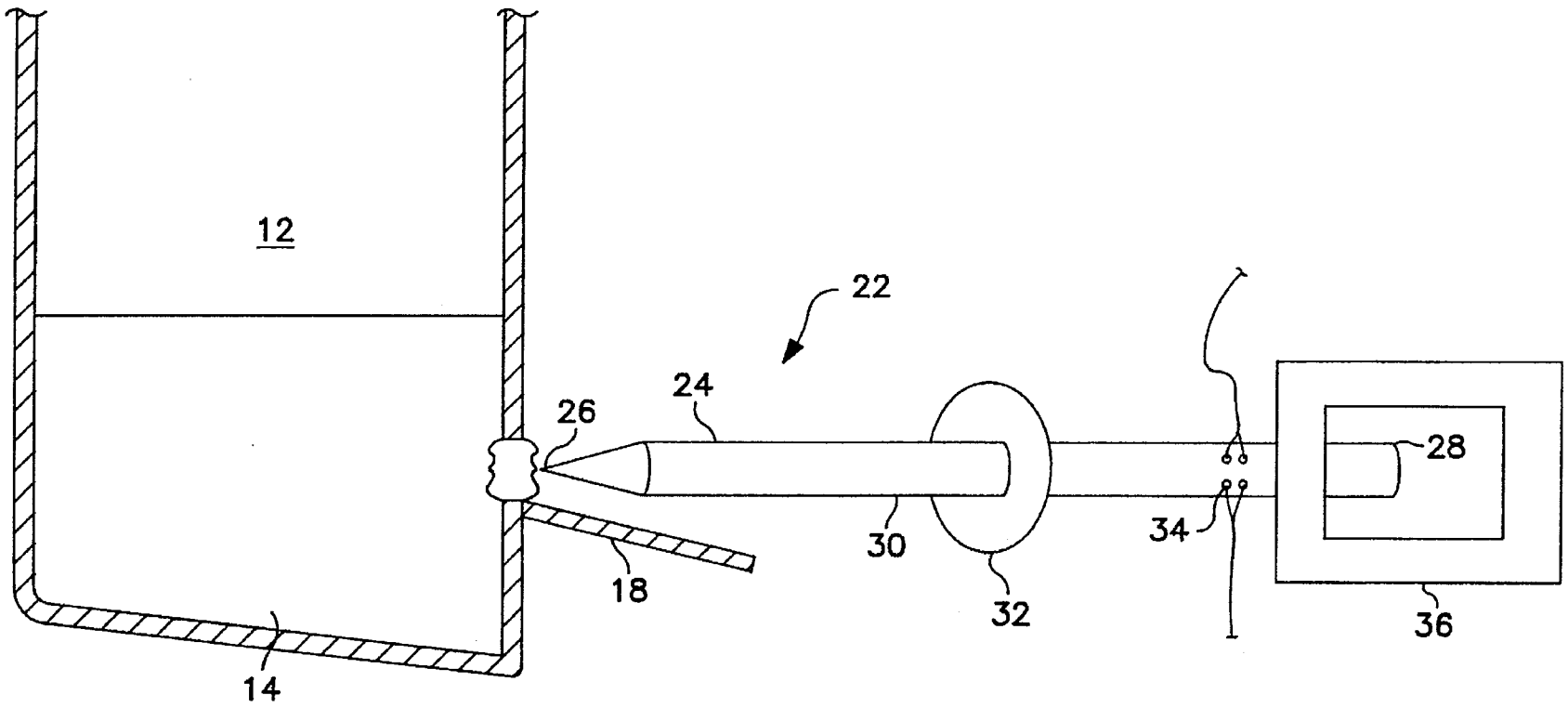
FIG. 4 is an enlarged cross-sectional view of a frozen smelt pour spout of a recovery boiler having a heating tube applied thereto.

A preferred embodiment of this invention for unfreezing a frozen smelt spout, as for example a spout which is intentionally or accidentally frozen during operation or frozen during shut down, is depicted in FIG. 4. As depicted in FIG. 4, heating element 22 heated to a temperature equal to or greater than the melting point of the smelt is applied to the smelt for a time sufficient to free the frozen smelt spout 18 to the desired extent. Thus, molten smelt 14 in furnace 12 is then free to flow from furnace 12 in a continuous variable flow and does not exit spout 18 in a heavy flow to react violently and explosively with water in tank 20.

The size, shape, mode of operation of heating element 22 may vary widely. The only requirement is that the size and shape of heating element 22 are such that it can be inserted into smelt spout 18 and into the opening of spout 18, and that heating element 22 includes some means of applying heat to all or a portion of the length of heating element 22 sufficient to raise its temperature to at least about the melting point of smelt 14 contained in the spout 18 and furnace 12. For example, the length of heating element 22 may vary widely. The length of heating element 22 can range from a length merely sufficient to pierce the opening of spout 18 to a length sufficient to penetrate the length of the opening of spout 18 and all or a portion of smelt 14 in the bottom of furnace 12. In the preferred embodiments of the invention, the length of heating element 22 is sufficient to penetrate the opening of spout 18 to reach the interior of furnace 14.

The cross-section of smelt heating element 22 is not critical and may vary widely. For example, the heating element 22 may be of regular cross-section such as circular, rectangular, hexagonal and the like, or of irregular cross-section. Heating element 22 may be of substantially uniform cross-section along its entire length or can be of non-uniform cross-section.

Heating element 22 is elongated and may be of any configuration. For example, heating element 22 may be straight or curved.

Smelt heating element 22 includes means for heating element 22 to a suitable temperature. Such means may vary widely and include means known to those of skill in the art such as electrical heating means, gas heating means, and the like.

Heating temperature may vary widely and should be sufficiently high to melt or soften the smelt. Usually, the temperature is sufficient to melt the smelt and is at least about 800° F. The heating temperature is preferably from about 800° F. to about 2000° F., more preferably from about 900° F. to about 1800° F. and most preferably from about 1000° F. to about 1500° F.

The materials used to construct the smelt heating element 22, may vary widely and include metals, ceramics, metal alloys and the like. Element 22 is usually constructed from metal or a metal alloy. Element 22 is preferably constructed of a metal alloy which is resistant to temperature and the corrosivity of molten smelt 14.

Figure 2:
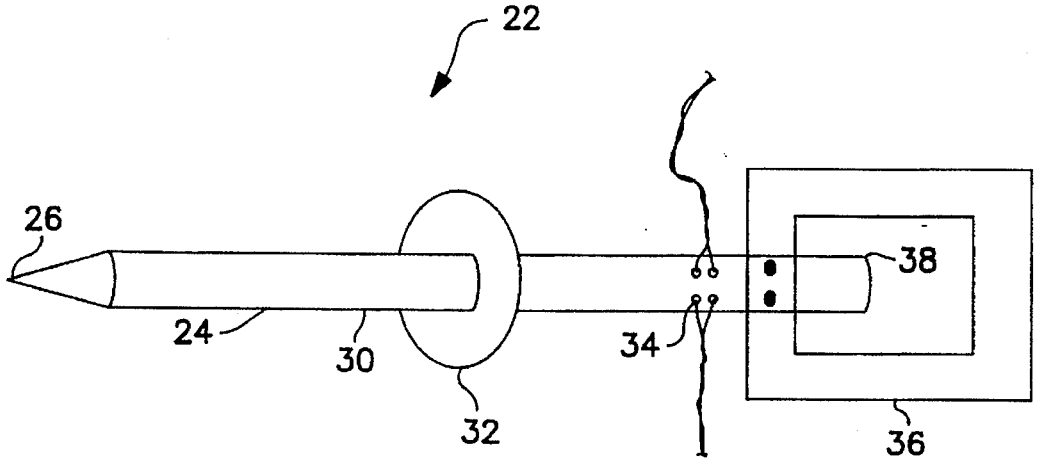
FIG. 2 is a cross-sectional view of a preferred heating element useful in the practice of this invention.

A preferred heating element 22 for use in the practice of this invention is depicted in FIG. 2. As depicted in FIG. 3, heating element 22 is a straight heat pipe of substantially circular cross-section, having a length which is sufficient to allow insertion of heat pipe 22 into the opening of smelt spout 18, into the bottom of furnace 12. As depicted in FIG. 3, heat pipe 22 includes three sections. One section is insertion or heating section 24, which may be of any shapes or configuration which extends from the in-board end 26 of pipe 22 to a point closer to the outboard end 28 of the pipe 22. Heat pipe 22 also includes intermediate section 30 which is fitted with an annular collar 32 to prevent molten smelt from running any further down the pipe 22. The remaining outboard section 28 of pipe 22 includes wells 34 for connection of electrical heating units in pipe 22 to a source of electrical heating units in pipe 22 to a source of electricity (not depicted). The heat pipe may be fitted with an insulative sheath to reduce heat loss and protect equipment and personnel. A handle 36 is connected to the end of outboard section 28 of pipe 22.

Obviously, many modifications and variations of the present invention are possible in light of the above teachings. It is therefore to be understood that, within the scope of the appended claims, the invention may be practiced otherwise than as specifically described,

What is claimed:

1. A method for shutting down and starting up a chemical recovery process in which a concentrated black liquor is burned in a furnace to produce a gas and a hot molten smelt in the bottom of said furnace and the hot molten smelt is discharged from said furnace via a smelt spout, said method comprising:

inserting an elongated heating element comprising a heating section into said spout such that said section is in said spout;

shutting down said furnace with said heating section of said element in said spout such that on solidification of molten smelt in said spout said element is fixed in said solidified smelt; and starting up said furnace by heating said heating section of said element to a temperature equal to or greater than the melting point of said solidified smelt to melt said smelt solidified in said spout and removing said element from said spout to provide a substantially open spout for discharge of said molten smelt from said furnace.

2. A method for shutting down and starting up a process for forming a hot molten material in a vessel, and discharging said molten material from discharge outlet of said vessel, said method comprising:

inserting an elongated heating element comprising a heating section into said outlet such that said section is in said outlet;

cooling down said material in said vessel and said outlet to solidify said material such that the heating section of said element is fixed in said solidified material in said outlet; and starting up said process by heating the heating section of said element to a temperature equal to or greater than the melting point of said solidified material to melt said solidified material in said outlet and removing said element from said outlet to provide a substantially open outlet for discharge of said molten material from said vessel.

3. A method for opening a discharge outlet of a vessel for use in forming a molten material in said vessel, and discharging said molten material from said vessel via said outlet wherein a material has solidified in said outlet preventing the discharge of material from said vessel, said method comprising:

heating said material solidified in said outlet with a heating section of an elongated heating element, said section having a melting point which is greater than the melting point of said material solidified in said outlet and said heating section heated to a temperature equal to or greater than the melting point of said solidified material, but less than the melting point of said heating section, said material solidified in said outlet heated for a time sufficient for a flow of heat from said heating section to Said solidified material Sufficient to melt said solidified material to provide a substantially open discharge outlet for discharge of said molten material from said vessel.

4. A method for opening a smelt spout of a furnace used in a chemical recovery process in which a concentrated black liquor is burned in the furnace to produce a gas and a hot molten smelt in the bottom of said furnace and the hot molten smelt is discharged from said furnace via a smelt spout where said smelt has solidified in said spout preventing the discharge of smelt from said furnace, said method comprising:

heating said smelt solidified in said spout with a heating section of an elongated heating element, said heating section having a melting point which is greater than the melting point of said solidified smelt and said section heated to a temperature equal to or greater than the melting point of said smelt but less that the melting point of said section, said smelt solidified in said spout heated for a time sufficient for a flow of heat from said heating section to said solidified smelt sufficient to melt said solidified smelt to provide a substantially open spout for discharge of said molten smelt from said furnace.

5. A method according to claim 2 or 3 wherein said vessel contains solidified material.

6. A method according to claim 2 or 3 wherein said vessel contains molten material.

7. A method according to claim 1 or 4 wherein said furnace contains solidified smelt.

8. A method according to claim 1 or 4 wherein said furnace contains molten smelt.

9. A method according to claim 1, 2, 3 or 4 wherein said heating element is heated electrically.

10. A method according to claim 1 or 4 wherein said furnace is the furnace of a recovery boiler.

11. A method according to claim 3 wherein said heating said material solidified in said outlet comprises contacting said solidified material with said heated heating section.

12. A method according to claim 4 wherein said heating said smelt solidified in said spout comprises contacting said solidified smelt with said heated heating section.

13. A method according to claim 1, 2, 3 or 4 wherein said heating element is a heat pipe.

14. A method according to claim 2 or 3 wherein said vessel contains no or substantially material.

15. A method according to claim 1 or 4 wherein said furnace contains no or substantially no smelt.

* * * * *